US010355343B2

(12) United States Patent
Umbert

(10) Patent No.: US 10,355,343 B2
(45) Date of Patent: Jul. 16, 2019

(54) BILLBOARD WITH CONCEALED ANTENNA FOR CELLULAR PHONE

(71) Applicants: PUBLICIDAD EXTERIOR S.R.L., Cordoba (AR); Javier Andres Eguia Terradas, Córdoba (AR)

(72) Inventor: Enrique Alberto Umbert, Córdoba (AR)

(73) Assignees: Publicidad Exterior S.R.L, Cordoba (AR); Javier A. Eguia, Cordoba (AR)

( * ) Notice: Subject to any disclaimer, the term of this patent is extended or adjusted under 35 U.S.C. 154(b) by 156 days.

(21) Appl. No.: 15/685,274

(22) Filed: Aug. 24, 2017

(65) Prior Publication Data

US 2018/0062247 A1 Mar. 1, 2018

Related U.S. Application Data

(60) Provisional application No. 62/379,486, filed on Aug. 25, 2016.

(51) Int. Cl.

| | |
|---|---|
| ***H01Q 1/12*** | (2006.01) |
| ***H01Q 1/24*** | (2006.01) |
| ***H01Q 1/42*** | (2006.01) |
| ***H01Q 1/44*** | (2006.01) |
| ***G09F 15/00*** | (2006.01) |
| ***G09F 23/00*** | (2006.01) |

(52) U.S. Cl.

CPC ..... *H01Q 1/246* (2013.01); *G09F 15/0006* (2013.01); *G09F 15/0037* (2013.01); *G09F 15/0043* (2013.01); *G09F 23/00* (2013.01); *H01Q 1/1228* (2013.01); *H01Q 1/1242* (2013.01); *H01Q 1/42* (2013.01); *H01Q 1/44* (2013.01)

(58) Field of Classification Search

CPC .... H01Q 1/246; H01Q 1/1242; H01Q 1/1228; H01Q 1/42; H01Q 1/44

See application file for complete search history.

(56) References Cited

FOREIGN PATENT DOCUMENTS

GB 2367178 A * 3/2002

* cited by examiner

*Primary Examiner* — Robert Karacsony

(74) *Attorney, Agent, or Firm* — Defillo & Associates, Inc.; Evelyn A. Defillo

(57) ABSTRACT

Advertising billboard with the ability to completely hide antennas for cellular telephones, or similar, in its interior without producing shielding of the exit and entrance of the electromagnetic waves for the telephony service, thanks to the provision of a discreet amount of windows permeable to the waves electromagnetic stripping of metallic materials the area of the windows. The windows are covered with laminar patches of non-metallic material permeable to electromagnetic waves, preferably FGRP fiberglass reinforced plastic; in combination with the traditional metal profiles, there are included alternate profiles of non-metallic material permeable to electromagnetic waves, which fall within the area of said window or aperture on the cover of the grid, in order to allow the inner antennas to the billboard rendering the normal service without shielding the electromagnetic signals, but hidden inside the billboard.

5 Claims, 4 Drawing Sheets

BILLBOARD WITH CONCEALED ANTENNA FOR CELLULAR PHONE

TECHNICAL FIELD

The present invention relates to a large advertising billboard, preferably of the type having large flat faces, which is exposed to severe atmospheric conditions and intended for the display of printed publicity, generally completely exposed to the outdoors with an innovative capacity of total hiding of the antennas for cellular telephony inside the advertising billboard itself and with the advantage of not presenting the adverse effects of shielding on the electromagnetic signal that would offer the traditional billboards of metallic construction.

BACKGROUND OF THE INVENTION

It is known that with the increasing popularization of the use of mobile phones, not only has the number of users of the cellular telephone service increased, but there has also been a demand that grows day by day demanding an increasingly better signal quality, and a greater traffic of digital data. All of the above is only appreciated by the user if it is available in a consistent way in the most varied geographies and environments, that is to say, with great geographic coverage.

To respond to these market demands, for years there has been a growing activity of installing antennas for cellular telephony in the public space, but, in contrast, the same users who demand more and more telephone services do not hide their annoyance against the invasive and unpleasant aspect of the antennas. It is that lack of visual integration of the antennas for cellular telephony, either in the urban or in the rural environment, that is due to the fact that for a purely technical necessity these antennas must be mounted at great heights and in open spaces very visible with the technical objective of obtaining adequate signal coverage. For this reason, the antennas for cellular telephony are exposed in a gross way, mainly because the visual appearance of such antennas for cellular telephony responds purely to technical and non-aesthetic issues. For these reasons, the antennas themselves, as well as their support structures, their cables, and auxiliary installations, form an aesthetic complex that is invasive and visually objectionable to their surroundings.

In response to this growing proliferation of "invasive" antennas for cellular telephony and with the aim of minimizing their visual impact on the environment, bearing in mind that at present this type of antenna has not yet obtained a good integration with the environment and without hampering its technical performance. In the prior art, a variety of alternative designs have been proposed to avoid the exposure of the antennas. This variety of designs is recurrently based on applying a technique of mimicking the environment.

At present, this mimicry with the environment has been obtained, for example, by disguising the antennas under various forms present in nature, in this way the telephone companies have considered that it would be possible to obtain an ingenious mimicry with the surroundings using facilities that simulate diverse elements of the reigning vegetation, such as false trees, false palms, false cactus, etc. An example of this type of camouflage can be observed in the U.S. Pat. No. 5,787,649A—the proposal of an antenna structure that simulates a palm tree. In practice, cell phone antennas are painted the same color as the false palm leaves and intertwine in a way to confuse the observer visually.

These camouflages do not shield the electromagnetic signal since they do not enclose or cover the antenna, they only disguise it, but it is still in sight. It is noteworthy that by the mere fact of simulating nature, they enjoy the benefits of natural adaptation to resist atmospheric factors, such as the structural loads of wind and rain, being able to place them in locations and orientations that favor their protection. The more hidden and less visible the better, contrary to what happens with the advertising billboards objective of the present invention, which should be exposed as visibly and as clear as possible.

Other techniques of mimicking or hiding antennas for cellular telephony are based on the imitation of building parts such as false chimneys, or the incorporation of false water tanks, false corners, or simulating certain building extensions among other tricks of mimicry, that is, always adding a new component that would not originally be there except for the need to incorporate new antennas. These structures totally or partially cover the antennas, modify the original environment, and are conditioned on their size, position and number of antennas or equipment to contain or hide. The fake water tanks limit the space where the antennas contain their external cylindrical shape, and once installed do not allow modifications to expand their capacity and ultimately continue to introduce more invasive elements that do not integrate with the environment. Incorporation into simulated chimneys or building continuations is very limited in size, amount of antennas, permeability and reach obtained because they are conditioned to be integrated into the roofs of buildings with structural constraints and face a growing urban regulation against visual pollution.

A person not skilled in the art might think that if one takes into account that cell phone antennas need generous air space for their installation and need to be arranged at great heights, they could easily be mounted on large size advertising billboards of the type which is used outdoors, such as along motorways, avenues and roads, which could be an appropriate solution. However in practice, to date, the billboard manufacturers have not found a suitable way to integrate the billboard with the antennas, and for this reason the billboards of the type used for the present invention do not integrate or hide antennas therein. This is understandable, since the manufacturers of billboards using the known techniques to date have been conditioned to use traditional metallic materials for the frame, as well as the rolls of cover plates, which shields the electromagnetic waves, preventing them from integrating antennas in their designs.

By way of example, patent application WO2011104393, entitled "Single-column advertising structure including a mobile telephone station", highlights the difficulty of manufacturers of public signage to integrate the antennas into the billboards. As illustrated and described in the patent application, the antenna must necessarily protrude above the first and second metal platforms and above the metal frame where the printed faces of the billboard are mounted, so that the antenna is exposed. If the antenna does not protrude above the billboard, the very structure of metal profiles and plates that are absolutely necessary to support structurally and cover laterally the billboard itself, would shield electromagnetic waves. A simple and clear representation of this type of signage merely serves to support the antennas above the billboard itself without hiding them is illustrated in FIG. 1, herein attached, being that FIG. 1 is representative of the prior art.

In FIG. 1 of the prior art, a typical external distribution of various types of antennas, including high gain cell phone antennas, can be clearly seen, where it is impossible to camouflage the mentioned antenna due to the screening effect that would result from the billboard's own metal structure. The FIG. 1, representative of the closest known prior art related to large size signage of the type of interest for the present invention has been illustrated, so as to discover the various layers of coverage to the reader, up and to the right, the various layers that make up the visible side of advertisement, in the foreground the outer layer, either a canvas or layer of paint containing the advertising design; below it is a layer of metallic coating obtained with metal sheets upholstering the metal grid that is last in the interior of the billboard as a grid or main frame and that provides the necessary structural resistance to the whole.

Those skilled in the art are well aware that large advertising billboards must be constructed in such a way that not only are they self-supporting, that is, not only must they be strong enough to support their own weight, but must also be strong enough to withstand the conditions of meteorological rigor to which they will be subjected, mainly loads by winds and rains, as well as the snow and other factors depending on the local climatology. In particular, billboards are especially vulnerable to wind and rain loads, due to large exposed surfaces (such as ship's sails), resulting in excessive accumulation of loads by wind and rain pressure.

Although the manufacturer knows in advance the conditions of wind and rain load that will act on his billboard in a certain place of installation, he is also fully aware that the advertising faces must be installed in a commercially useful way, that is, prioritizing the orientation of the faces advertising to be visible to the people who travel with their vehicles or simply as pedestrians. Therefore, manufacturers know that the position in which the advertising faces are facing the direction of the wind or rain is not always the most favorable, and for this reason, the billboards are constructed prioritizing their mechanical resistance according to the rules, resorting to the use of metallic profiles, screwed or welded in connection knots to after forming the main frame to cover them with the corresponding metallic panels in order to obtain the necessary mechanical resistance of the frame and the support surface for the advertising canvases.

For that reason, if a telephone company tried to use the current large advertising billboards available in the market of frame and metal coating and tried to camouflage inside the billboard the antennas for cellular telephony, it could not obtain electromagnetic signal of service, since the own structure of the billboard would almost completely shield the emission and reception of electromagnetic waves. In view of such circumstances, the inventors here understand that there is still a need to provide a new type of structure of a large advertising billboard that allows the complete concealment of the antennas for cellular telephony and yet allows a complete and reliable permeability to the electromagnetic waves of the mentioned antennas for cellular telephony with a complete and easy access for their maintenance and updating, all without damaging the mechanical structural response to wind, rain and similar loads.

SUMMARY OF THE INVENTION

The object of the present invention is to provide an advertising billboard with the ability to completely hide antennas for cellular telephony, or the like, within the advertising billboard. The billboard is provided with a frame composed of a plurality of interconnected profiles defining at least one grid, wherein each grid presents an outer and an inner face, a metallic laminate coating on the outer face of the grid, in such a way that the proposed new advertising billboard has at least one open window in the metallic laminate, which is covered with a laminar patch of non-metallic material permeable to electromagnetic waves, preferably fiberglass reinforced plastic (FGRP) (also known by its acronym in English, FGRP, "fiberglass reinforced plastic"). It is possible to provide at least one cellular telephone antenna completely concealed behind the laminar patch of non-metallic material permeable to electromagnetic waves, that is, into the interior of the grid (back of the grid). In combination with the above, it is proposed that the interconnected profiles be metallic except for alternate profiles, profiles that replace what would originally have been metallic profiles, in such a way that the interconnected alternate profiles that fall within the area of the mentioned profile window or opening on the cover of the grid also result from non-metallic material permeable to electromagnetic waves such as the patch of the window, all this is in order to allow the inner antennas to the billboard to provide the service without shielding the electromagnetic signals.

It is therefore also an objective of the present invention to provide an advertising billboard wherein the electromagnetic permeable non-metallic material suitable and applicable to the patch and to the alternate profiles is preferably selected from the group consisting of fiberglass reinforced plastic (FGRP), polycarbonate (PC), polyvinyl chloride (PVC) and polypropylene (PP), not necessarily using as a limitation the same type of material at the same time for the patch and alternate profiles providing the desired permeability to electromagnetic waves.

It is therefore an object of the present invention to provide an advertising billboard wherein laminate patches of non-metallic material permeable to electromagnetic waves are manufactured as fiberglass reinforced plastic (FGRP) panels, preferably rectangular, allowing to effectively cover the contour of the windows of the metallic sheet coating on the outer face of the grid, also comprising rectangular steel sheet panels.

It is therefore another object of the present invention to provide an advertising billboard with the capability of accommodating completely in its interior one or more antennas for cellular telephony or other type of devices of emission and reception of radio frequencies, electromagnetic waves and the like, without shielding the output and input of electromagnetic waves occurring (radio frequencies, microwaves, and the like) thanks to the provision of a discrete quantity of windows permeable to electromagnetic waves stripping of metallic materials the area of the mentioned windows. The number of windows being permeable to the electromagnetic waves are enough to allow the service of all the functional antennas inside the billboard, but being in quantity those adapted to not interfere with the necessary mechanical resistance of the structure of the billboard, in order to obtain an advertising billboard of completely functional dimensions from the point of view of advertising view and its service as an antenna.

DETAILED DESCRIPTION OF THE INVENTION

As mentioned above, the main object of the present invention is to completely hide the antennas for cellular telephony (10) inside the advertising billboard (1), and at the same time, avoid the effect of shielding the electromagnetic waves that present the current metal structures. While the type of billboard preferably illustrated is a single-post type (one post) with two visible advertising faces raised and supported on a single support column (13), the principles and teachings of the present invention may be applied to a wide variety of billboard formats based on the teachings developed below.

Figure 1:
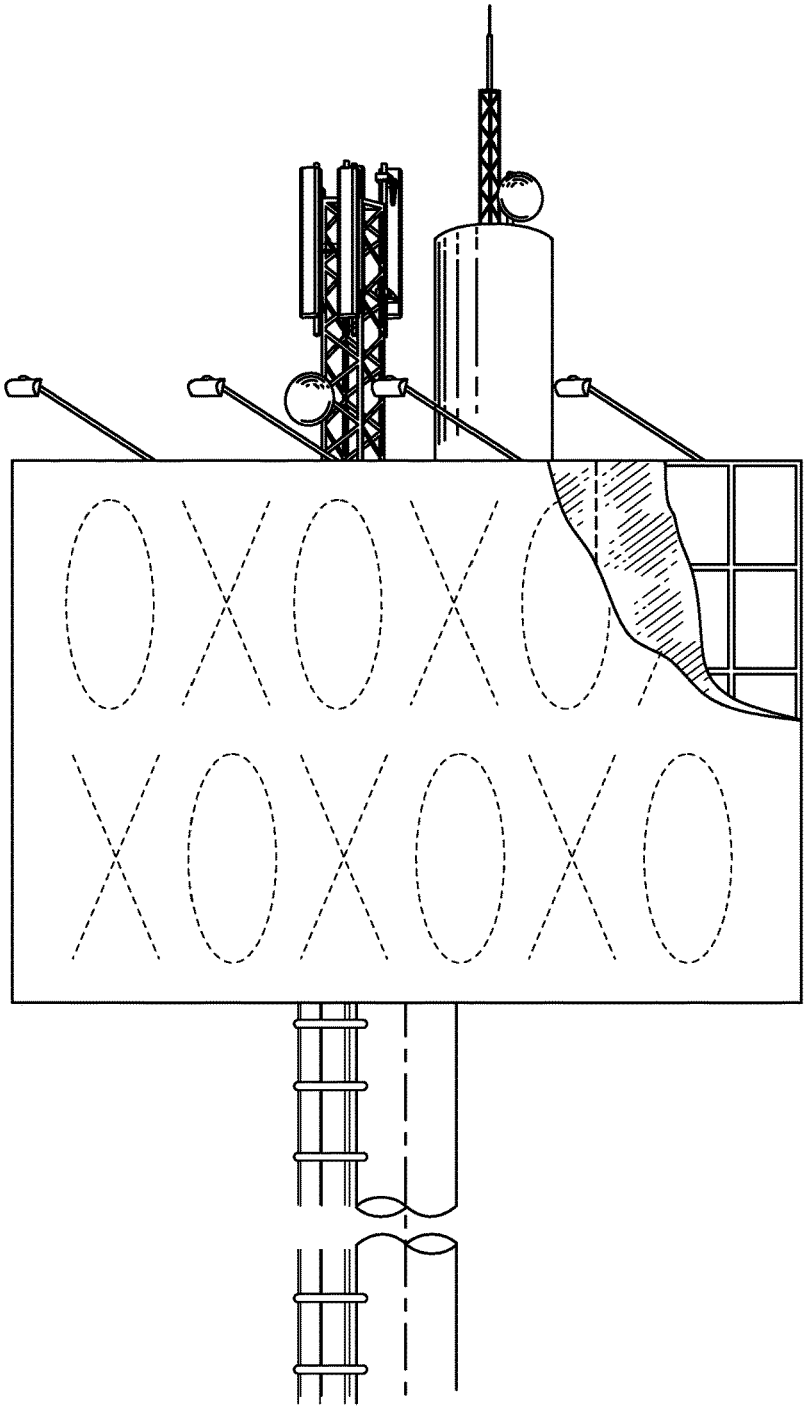
Fig. 1 Prior Art
FIG. 1 shows a front perspective view of the antenna according to the prior art.

FIG. 1 is a general prior art depiction showing a large outdoor advertising billboard mounted on a mono-column of the type intended for highway advertising, telephony antennas, as well as other types of broadcast and reception antennas of electromagnetic waves are looming over the billboard to avoid shielding the metal structure of the advertising billboard itself.

For the purposes of the present invention, regardless of the specific advertising billboard format, in order to apply the teachings of the present invention, an advertising billboard (1) will comprise a frame (2) composed of a plurality of profiles (7) interconnected with each other (in the traditional style) defining at least one grid (5), wherein the grid has an inner face (51) and an outer face (52) and also comprises a metallic sheet covering (4) (In the traditional style) on the outer face (52) of the grid (5). Generally, the metallic sheet covering (4) is rectangular or strip-shaped metal panels, or metal sheets (4) which are adhered to the grids (5), that is, on the corresponding grids (5A, 5B, etc.). The frame of an advertising billboard of the type used as the basis for the present invention is formed by a plurality of metal profiles (7) such as bars, beams, columns and the like, interconnected in such a way as to define hereinafter referred to as "grids"; each grid (5) is generally flat and, because of the need for structural strength, it is constructed of metal material and is formed into a grid, grid or latticework mode by interconnecting the metal profiles by means of welding, screws or other means of attachment, and for this reason they will be denominated like "interconnected".

As a person skilled in the art knows, when a single grid is provided to form the frame, a billboard with a single front face is obtained, wherein the frame matches the grid, in which case the part of the (back of the grid) is never visible to the observer, for example, because it is faced against a wall or placed embedded in some other structure. On the other hand, when two racks are provided, forming the frame of the advertising billboard, a double-sided billboard is obtained, whether the faces are parallel or angled (the latter arrangement of very frequent use); following the reasoning when providing three grids to form the frame of the billboard is obtained an advertising billboard with three visible faces, and so on, as needed.

Figure 2:
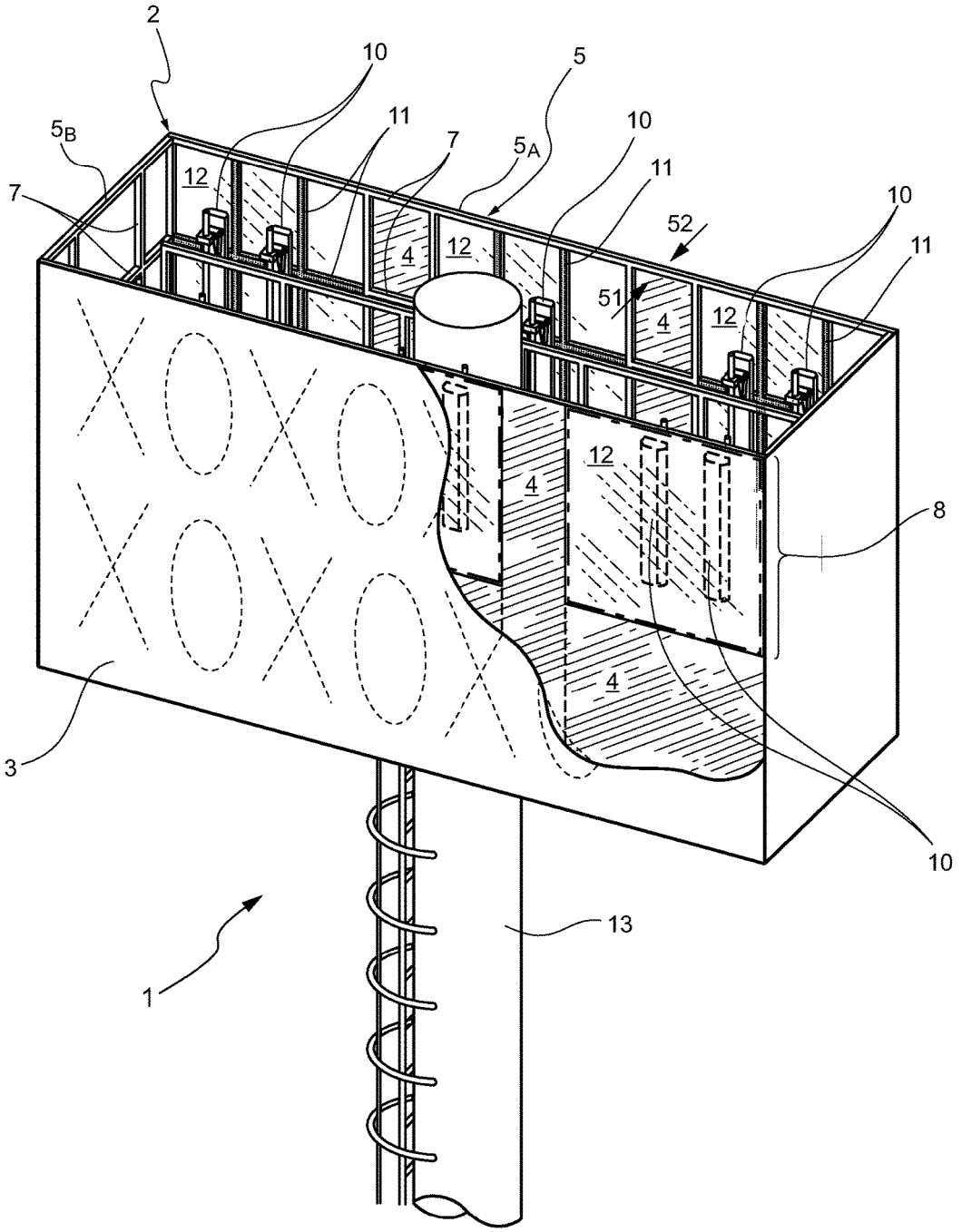
FIG. 2 shows a front perspective view illustrating an advertising billboard with the antenna concealment capability for cellular telephone in accordance with a preferred example of the present invention.

FIG. 2 is a perspective view, and taken from above illustrating, an advertising billboard with the antenna concealment capability for cellular telephony in accordance with a preferred example of the present invention having partly cut off the printed advertising canvas in order to observe the patches permeable to the electromagnetic waves embodying the present invention; The antennas hidden behind the patches permeable to electromagnetic waves for reference and clarity of description are also shown in phantom lines, and the windows permeable to electromagnetic waves have been highlighted with frames in center lines In FIG. 2 there is shown an advertising billboard (1) having a support column (13) supporting the frame (2). The frame (2) forms a closed structure where the interior of the frame cannot be seen by the persons viewing the billboard from a distance. In a variation of the invention of the frame (2) it has a pair of main grids (5A) having large dimensions and a pair of secondary side grids (5B) which are of smaller dimensions thus defining a general parallel-piped shape, in spite of other configurations that are possible. The main grids (5A) are intended to support the main advertising faces and the secondary side grids (5B) are concealing or side closing faces. The number of main grids (5A) and secondary side grids (5B) will depend on the shape the user wishes the frame (2) to have.

A plurality of high gain cell phone antennas (10) is provided within the frame (2) for high gain cell phone, without this being a limitation. The antennas (10) are grouped in pairs and distributed along the interior of the main grids (5A). The antennas (10) are completely covered within the interior of the frame (2).

Figure 3:
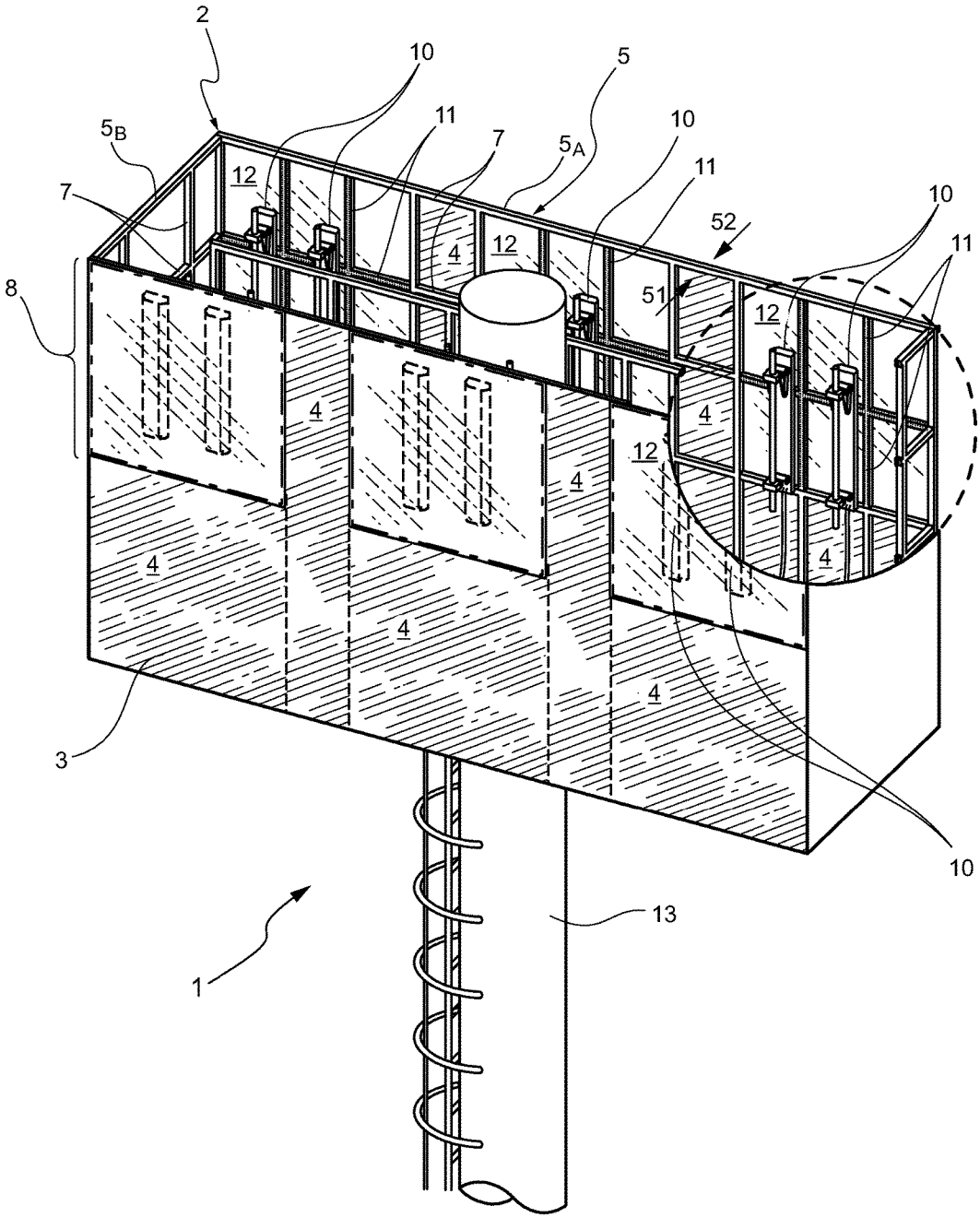
FIG. 3 shows a front perspective view illustrating the advertising billboard according to the exemplary preferred embodiment of the present invention without the advertising canvas.
Figure 4:
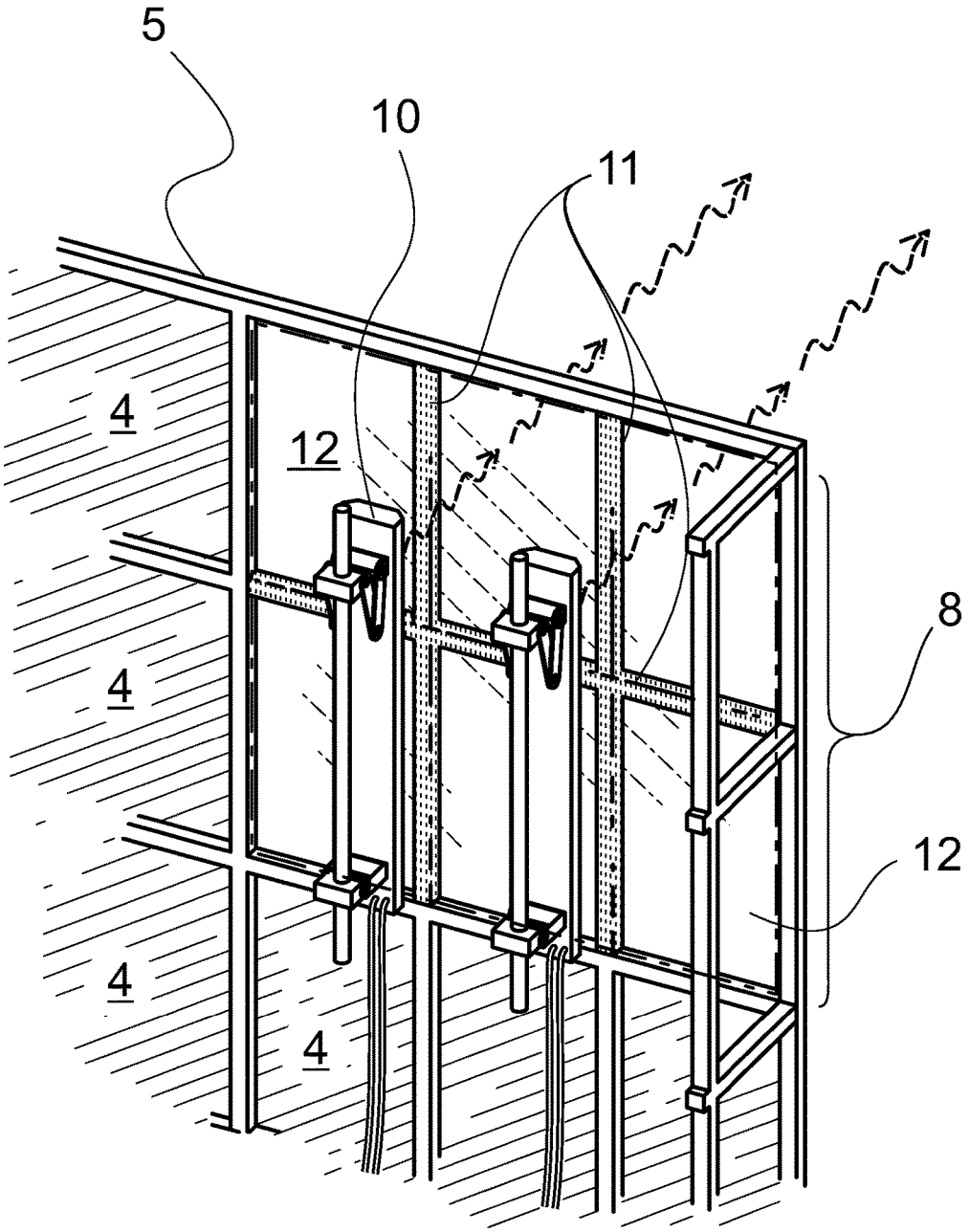
FIG. 4 shows a detailed amplified view of the two antennas indicated in FIG. 3, so as to illustrate the integration of the antennas into the frame.

FIG. 3 is a perspective view, taken from above, illustrating the advertising billboard according to the exemplary preferred embodiment of the present invention, having removed the advertising canvas and partially cut off part of the frame to observe without visual interference, the position of two of the antennas integrated within the billboard (marked in a circle of dashed lines), and which are illustrated in detail in FIG. 4. Again, the windows permeable to the electromagnetic waves have stood out with frames in centerlines for easy reference purposes.

In FIG. 3, the inside of the frame (2) is better shown to the right of the figure and the arrangement of the cellular telephone antennas (10) can be clearly seen. The inner support structure has been omitted for the sake of clarity, and is located in the back of the antennas (10), that is, behind the emission direction of the antennas. As anticipated, a top right portion of the frame (2) has been trimmed to allow observing, by way of example, the positioning of two of the cellular telephone antennas (10), which have been highlighted within a circle of line strokes to reference FIG. 4 in enlarged detail.

While the frame (2) may be more or less complex in the form of billboards of one, two, three, four or more visible faces, the person skilled in the art will understand and will not hesitate to interpret the existence of an "inner side" or "back" where any object on the inside or back side of the billboard will be completely hidden from view of the viewer who is watching the billboard from the normal viewing position of the billboard. There is also an "outer side" or "front side", such that everything on the outside or front of the frame (2) is considered to be on the outer side of the frame (2), therefore not necessarily hidden. Therefore, even in the particular case where the billboard has a single visible side with advertising, that is a single front face supported on a front grid, the frame 2 may be formed by a single grid (5) to which the above mentioned references may also be applied, i.e. it will also have an inner side (back) and an outer side (front) and more particularly each grid (5) forming the frame (2) of the advertising billboard will have an inner face (51) and an outer face (52) in accordance with the above criteria.

In the customary practice of the manufacture of advertising billboards, in order to provide support for the visible advertising panel (3), the frame (2), more specifically the grids (5), are coated with a metallic sheet covering (4), preferably made up of metal sheets or metal panels, among other options, which cover the exterior of the grids (5A, 5B), preferably rectangular, notwithstanding the purposes of the present invention because the advertising billboard will also have various components completely hidden in the interior of the frame (2), mainly the antennas (10) and the auxiliary equipment for their operation, the provision of the metallic sheet covering, that is the metal sheets that cover the exterior of the grids (5) is fundamental to hide the inside of the billboard. However, because the metal plates of the traditional billboards shield (that is interfere, attenuate and even prevent) the passage of electromagnetic waves, it would be impossible to offer the cellular telephone service with this traditional structure, were it not for the ingenious incorporation of a plurality of laminar patches (12) of material permeable to electromagnetic waves at suitable sites, that is a plurality of patches incorporated particularly in the "contour of emission/reception" zones of electromagnetic waves of the corresponding telephony antennas (10).

Therefore, for the structural purposes of the present invention, the cellular telephone antennas (10) will be covered by a laminar patch (12) of non-metallic material permeable to electromagnetic waves. Therefore, the antennas (10) will be completely hidden from view by persons, but with the ability to emit and receive the electromagnetic waves to render their service, since the electromagnetic waves can in principle pass through said laminar patch (12) permeable to electromagnetic waves.

The laminar patches (12) of electromagnetic permeable material proposed here are illustrated in FIGS. 2 to 4 in rectangular form as it is the simplest industrial mode to obtain them and adapt them to the general shape of the billboard (generally rectangular, although any other composite shape is possible, without limitation) and thus combine them with the rectangular metallic sheet covering (4), however this is not a limitation for the purposes of the present invention provided that the patches (12) cover the opening area or window (8) of the grid (5) where the large contour flow of the emission and reception of electromagnetic waves of the cellular telephone antennas (10) takes place.

In particular, such laminar patches (12) of material permeable to electromagnetic waves for the purposes of the present invention are preferably made of fiberglass reinforced plastic (FGRP), which combines excellent mechanical strength with a high permeability to the pitch of electromagnetic waves. Also, other materials in addition to fiberglass reinforced plastic (FGRP) may be used for such patches (12) permeable to electromagnetic waves, among which are found, without, however, being limited to:

- Polycarbonate
- PVC fabric (polyvinyl chloride)
- Fiberglass sheets
- Polyester reinforced with fiberglass
- Inks of latex digital printing, UV and solvent of advertising graphics.
- Lead-free paints for mimicking and integration with the urban environment of the site.

In summary, the non-metallic material permeable to the electromagnetic wave for an advertising billboard according to the present invention is selected from the group that consists of fiberglass reinforced plastic (FGRP), polycarbonate (PC), polyvinyl chloride (PVC) and polypropylene (PP), fiberglass and glass fiber reinforced polyester. Although the inventors understand that this is not a limitation, since other materials could well serve as a non-metallic material permeable to electromagnetic waves, and as will be understood by one skilled in the art.

It should be particularly noted that the present inventors have found that if, for example, the total replacement of the metal sheets by a material such as the above-mentioned FGRP is to be practiced, the strength of the assembly will be weakened excessively, and so that, contrary to what one might think, surprisingly, it has been found that the application of a limited number of "AD HOC" patches of permeable lamellae that are specifically installed in areas where it is strictly necessary to have maximum effectiveness in the transmission of the electromagnetic wave is provided by the present invention. In this sense, patches are proposed distributed on the electromagnetic emission/reception face of the advertising structure, thus offering an optimum performance of emission and reception of the telephony signal, filtering any other type of emission other than the one that enters and leaves by mentioned patches (effective useful signal of service), all this while offering the benefit of not weakening the mechanical resistance of the advertising structure allowing a commercial performance of optimal characteristics, since the intervention is not visible or perceptible from the urban environment.

FIG. 4 illustrates in greater detail the two antennas indicated in FIG. 3, so as to illustrate the integration of the antennas within the frame behind the grid cover patch and in the window where the metal profiles have been replaced by non-metallic profiles, both of which are permeable to electromagnetic waves. The canvas with the printed advertising is also illustrated only for the purpose of reference in dashed line.

As shown in FIGS. 2 and 3, as well as in the enlarged detail in FIG. 4, the antennas (10) are disposed towards the inside of the frame (2), that is on the back of the corresponding grid (5), completely hidden behind a laminar patch (12) of non-metallic material permeable to electromagnetic waves covering a window (8) of the metallic sheet covering (4) that covers the outer face (52) of the grid (5). For the purposes of the present invention, the window (8) is effectively an opening made in the mentioned metallic sheet covering (4), for example by screwing, cutting or simply dislodging from the metal sheets a discrete area of the surface of the grid (5), preferably but not limited to rectangular-shaped openings.

Also, without forgetting that the frame (2) has taken into account that the advertising billboard also has the grids (5) formed by interconnected metal profiles (7), which would also shield and reduce an electromagnetic signal. Thus, in combination with the laminar patches (12) of non-metallic material permeable to electromagnetic waves, there are provided interconnected alternate profiles (11), which are comprised within the area of the window (8), wherein the alternate profiles (11) also result from non-metallic material permeable to electromagnetic waves, so that the sector of the windows (8) is completely permeable to the emission and reception of the antennas. For the purposes of the present invention, the alternate profiles (11) are those which replace the traditional metal profiles (7), the alternate profiles continuing the frame supporting structure, may coincide, almost emulating or continuing the original structure or may alter the original design, increasing or decreasing the number of profiles expected to be observed, its section may vary from metallic ones, be thinner, thicker, have another geometry, and so on. All this taking into account that the material of the alternate profiles (11) is different from the material of the metal profiles (7).

More specifically, the present inventors consider that a preferred embodiment of the present invention, but without limiting it, is to provide such patches (12) in the form of fiberglass reinforced plastic (FGRP) panels with sufficient thickness, stiffness and (4) absent in the area of the window (8) and that the interconnected alternate profiles (11) comprised within the area of the window (8) that go in replacement of what would originally have been metallic profiles, are also provided as alternate profiles (11) of fiberglass reinforced plastic (FGRP) with sufficient thickness, rigidity and texture to overcome the physical lack of metal profiles (7).

With respect to the latter, that is to say, the replacement of the metal profiles (7) by alternate profiles (11) permeable to the electromagnetic waves of fiberglass reinforced plastic (FGRP), is practiced by replacing the metal profiles (7) with rails, beams, columns, or the like, as if the crossbeams or bars of a window are treated in such a way as to avoid interfering with the electromagnetic waves being sent and received by the antennas hidden behind the corresponding patch (12).

Therefore, an advertising billboard (1) according to the present invention comprises a frame (2) composed of a plurality of interconnected profiles (7) defining at least one grid (5), wherein this grid has an inner face (51), and an outer face (52), and a metallic sheet covering (4) on the outer face (52) of the grid (5), so that it may even intervene on a pre-existing billboard to convert it into a modified billboard so that it can (1) in accordance with the teachings of the present invention have at least one window (8) covered by a laminar patch (12) of non-metallic material permeable to electromagnetic waves, wherein there is hidden behind the laminar patch (12) of non-metallic material permeable to electromagnetic waves, at least one (10), and in that the interconnected profiles (7) are metallic except for the interconnected alternate profiles (11) which replace any type of metal profile which could fall within the area of the window (8) of non-metallic material permeable to electromagnetic waves.

For purposes of guidance, and in order to provide practical reference information to a person skilled in the art, the best practice is summarized below for obtaining the integration of the laminar patches (12) and the alternate profiles (11), both of non-metallic and permeable to electromagnetic waves, to be connected with the metal material of the grids (5). Namely, the fiberglass reinforced plastic (FGRP), polycarbonate or similar non-metallic material do not possess the same physical and adhesion properties as the metallic structural components, and therefore it is not easy to integrate them because both materials are not mechanically compatible to be joined by welding, which is the most used mode for this type of advertising structure. In this sense, it is proposed to bond ferrous materials to non-ferrous materials by means of fastening systems such as those used to obtain bolted or bolted connections (screws, nuts, threaded rods, etc.), in order to not lose resistance of the materials and the mechanical behavior of the same. However, since it is also possible to carry out the reconversion of existing billboards, such as prior art billboards, which would of course be of great interest to telecommunication companies, and in order to provide them with the benefits of the present invention, some of the following procedures and recommendations are proposed as follow:

Select existing advertising structures within the assigned and specific searches of sites under the requirements of cellular companies in order to make use of them, according to the need of the telecommunications company to integrate it into its network of coverage of the region.

Determine the orientation of the "azimuth" antennas that will fix the position to where the electromagnetic waves of the antennas should be directed according to the specific need of the telecommunications company and the best use of the advertising structure. These orientations are those that the transmission antennas need to connect with the rest of the network and reach the maximum coverage with the highest possible efficiency within the selected zone.

Structurally verify and design the engineering details for the compatibility and adequacy of the existing billboard, in order to convert it into an advertising antenna without affecting the original advertising objective of the same, nor the structural set. To this end, to validate the structural calculations, again taking into account those elements such as: telephony equipment, walkways, cabling, ladders, antenna trunks, that must be verified again structurally to analyze the feasibility of the intervention.

Establish the location of the laminar patches (12) of non-metallic material permeable to electromagnetic waves according to the orientation of the antennas (azimuths). The laminar patches (12) will be installed "AD HOC". In order to be able to place the laminar patches (12) and the alternate profiles (11) both of non-metallic materials and permeable to the electromagnetic waves in the existing billboard, the metallic part must be replaced where it will specifically have to transfer the electromagnetic wave of the antennas through the advertisement without generating interference. To this end, the FGRP or "permeable material" panels described above are placed without affecting the original morphology of the structure and the advertising objective of the same.

In short, everything related to the necessary technical operation of the telecommunications company (special gateways of accessibility to the equipment to be installed, specific accesses, stairs, guardrails, transmission equipment, cabling) will be integrated and/or hidden without changing the advertising purpose of the structure in question. In this sense, all the elements of connectivity of the mobile telephone company as well as permeable panels or patches will be hidden, which will be invisible under the advertising graphic in such a way as to facilitate the task of the manufacturer or industrialist who wants to implement the present invention.

It is noted that the various components commonly provided to give access to advertising billboards at great heights, such as ladders, struts and support bars of the antennas, access walkways, gateways, railings, as well as various light carriers, and the like, may or may not form part of the final structure obtained without this constituting any drawback to the present invention provided that they do not shield the sector of the emission and reception windows obtained here. Therefore, for the sake of clarity of the present invention and for the purpose of obtaining a concise document avoiding unnecessary descriptions for a person skilled in the art, although illustrated, its description is unnecessary.

The invention claimed is:

1. An advertising billboard (1) comprising:

a frame (2) comprising a plurality of interconnected profiles (7) defining at least one grid (5), wherein each grid has an inner face (51) and an outer face (52);

a metallic sheet covering (4) on the outer face (52) of each grid (5);

at least one window (8) located in the metallic sheet covering;

a laminar patch (12) made of a non-metallic material permeable to electromagnetic waves covering the outer face of the grid and at the location of the windows (8);

at least one cellular telephone antenna (10) located entirely on the inner side of the grid and at the location of the windows;

alternate profiles forming a frame for the window, the alternate profiles are made of a non-metallic material permeable to electromagnetic waves; where the antennas are completely covered by the frame; where the profiles (7) are metallic.

2. The advertising billboard according to claim 1, wherein the non-metallic material permeable to electromagnetic waves is selected from the group consisting of fiberglass reinforced plastic (FGRP), polycarbonate (PC), polyvinyl chloride (PVC), Polypropylene (PP), fiberglass, and glass fiber reinforced polyester.

3. The advertising billboard according to claim 1, wherein the laminar patch of non-metallic material permeable to electromagnetic waves comprises fiberglass reinforced plastic (FGRP) panels and the metallic sheet coating on the outer face of the grid comprises steel panels.

4. The billboard according to claim 3, wherein the window and the laminar patch are rectangular.

5. The advertising billboard according to claim 1, wherein the non-metallic material permeable to the electromagnetic waves of the interconnected alternate profiles is made of fiberglass reinforced plastic (FGRP).

* * * * *